United States Patent [19]

Englert et al.

[11] 4,049,758

[45] Sept. 20, 1977

[54] FUEL INTRODUCTION DEVICE FOR INTERNAL COMBUSTION ENGINE

[75] Inventors: Robert Dixon Englert, Corona Del Mar; Kenneth Ronald Armstrong, Lakewood, both of Calif.

[73] Assignee: Dresser Industries, Inc., Dallas, Tex.

[21] Appl. No.: 661,557

[22] Filed: Feb. 26, 1976

Related U.S. Application Data

[62] Division of Ser. No. 384,166, July 30, 1973, abandoned.

[51] Int. Cl.[2] ..... F02M 9/02

[52] U.S. Cl. ..... 261/62; 261/DIG. 56; 261/DIG. 39; 261/DIG. 78; 261/78 R; 239/498

[58] Field of Search ..... 239/498; 261/DIG. 56, 261/DIG. 39, 62, 53, 116, 118, 78 R, DIG. 58, DIG. 59, DIG. 78

[56] References Cited

U.S. PATENT DOCUMENTS

| | | | |
|---|---|---|---|
| 963,354 | 7/1910 | Braemer | 239/498 |
| 1,143,779 | 6/1915 | Pembroke | 261/DIG. 58 |
| 1,875,713 | 9/1932 | Dusevoir | 261/DIG. 39 |
| 2,102,800 | 12/1937 | Killmeyer et al. | 261/DIG. 39 |
| 2,310,984 | 2/1943 | Mock et al. | 261/DIG. 39 |
| 2,493,595 | 1/1950 | Rieger | 239/498 |
| 3,290,025 | 12/1966 | Engalitcheff, Jr. | 261/DIG. 11 |
| 3,290,867 | 12/1966 | Jacir | 261/DIG. 11 |
| 3,347,536 | 10/1967 | Sutton | 261/DIG. 39 |
| 3,417,961 | 12/1968 | Shorrock | 261/62 |
| 3,778,038 | 12/1973 | Eversole et al. | 261/DIG. 56 |

*Primary Examiner*—Tim R. Miles
*Attorney, Agent, or Firm*—Robert W. Mayer

[57] ABSTRACT

A combination fuel introduction, distribution and air shaping device is provided for a fuel carburetion system of an internal combustion engine. The distributor is elongated and of generally inverted tear-drop cross-section. Fuel discharge openings are spaced longitudinally near or at the bottom of the distributor. Spaced-apart teeth aligned with the fuel openings or other means to prevent liquid bridging and depend from the bottom or discharge side of the distributor. The distributor extends across the intake air duct of an air-fuel mixing and modulating device that is adapted to deliver a mixture of finely divided fuel droplets in air to the intake manifold of an internal combustion engine. The body of the distributor divides the intake air flow into two converging air streams which entrain the fuel as liquid droplets sweeping it from the downstream side of the distributor and uniformly distributing the droplets in the air streams.

4 Claims, 5 Drawing Figures

FUEL INTRODUCTION DEVICE FOR INTERNAL COMBUSTION ENGINE

CROSS REFERENCE TO RELATED APPLICATIONS

1. This application is a division of application Ser. No. 384,166, filed July 30, 1973, entitled "Fuel Introduction Device For Internal Combustion Engine", now abandoned.

2. Eversole and Berriman U.S. Pat. No. 3,778,038, issued Dec. 11, 1963 entitled "Method and Apparatus for Mixing and Modulating Liquid Fuel and Intake Air for an Internal Combustion Engine" (hereinafter "CR-1"0).

BACKGROUND OF THE INVENTION

The field of art to which the invention pertains includes the art of air and fuel carburetion systems for internal combustion engines and to fuel introduction or metering means for such systems. Patents disclosing and claiming such apparatus are generally classified in Patent Office Classes 239 and 261.

In the past, it has generally been considered either undesirable or impractical to form and maintain a well atomized and distributed mixture of liquid fuel droplets and air for introduction into the intake manifold and thence to the cylinders or other combustion chambers of an internal combustion engine.

Fuel atomizing devices of the type disclosed in CR-1 are required to operate over an extremely wide range of both air and fuel introduction rates when used in an automobile. Air and fuel introduction rates may increase by a factor of as much as 40 in comparing idling conditions with those encountered during rapid acceleration. Successful operation of such devices in the supplying of a uniform dispersion of fuel droplets in air to the cylinders of an engine requires distribution of the fuel in the air stream in a uniform manner. While this can be attained using conventional spray nozzles within relatively narrow ranges of air and fuel flow rates, only apparatus having special characteristics provides uniform fuel introduction where the "turn-down" ratio of both the air and fuel flow rates is as large as it is in devices of the type dissolved in CR-1. These characteristics include the ability to maintain streamline flow of the air over a wide range of flow rates and the avoidance of the formation of fuel droplets of too large a size at the point at which the liquid fuel enters the air stream thus, in turn, effecting uniform distribution of fuel into the air stream. It is also desirable that the ratio of the cross-sectional areas of the inlets of the air flow passages wherein flow acceleration takes place to the cross-sectional area at point of maximum constriction fall within certain limits.

Researchers in the field of liquid atomization have determined that certain characteristics are highly desirable for the production of liquid fuel-air mixtures suitable for combustion. These include:

1. The paralleling of the flow of air and liquid to be atomized

2. The uniform introduction of the liquid to be atomized into the atomizing air stream.

SUMMARY OF THE INVENTION

An elongated distributor or fuel bar for dispensing liquid fuel in droplet form extends across the air intake duct of an air-fuel mixing and modulating device so as to shape and divide the air flow into two converging streams. Preferably the distributor has a cross-section generally having the shape of an inverted tear-drop. Liquid fuel issuing from openings spaced along the downstream side of the distributor is swept into the high-speed air stream and subsequently comminuted into minute droplets. At the point of entrainment of the fuel in the air the directions of air and fuel flow are essentially parallel. Means are provided adjacent the fuel openings on the downstream side of the distributor to prevent bridging between adjacent fuel streams which might occur at lower air velocities and cause non-uniform entrainment of liquid droplets into the air stream.

It is an object of this invention to provide a fuel distributor that will provide effective fuel atomization while at the same time being well adapted for use in a carburetion system within which sonic flow is maintained during substantially the entire operating range of the engine.

It is another object of the invention to provide a combination fuel distributor and air flow shaping device effective in producing a mixture of air and finely divided fuel that may be effectively burned in the cylinders of an internal combustion engine.

Figure 1:
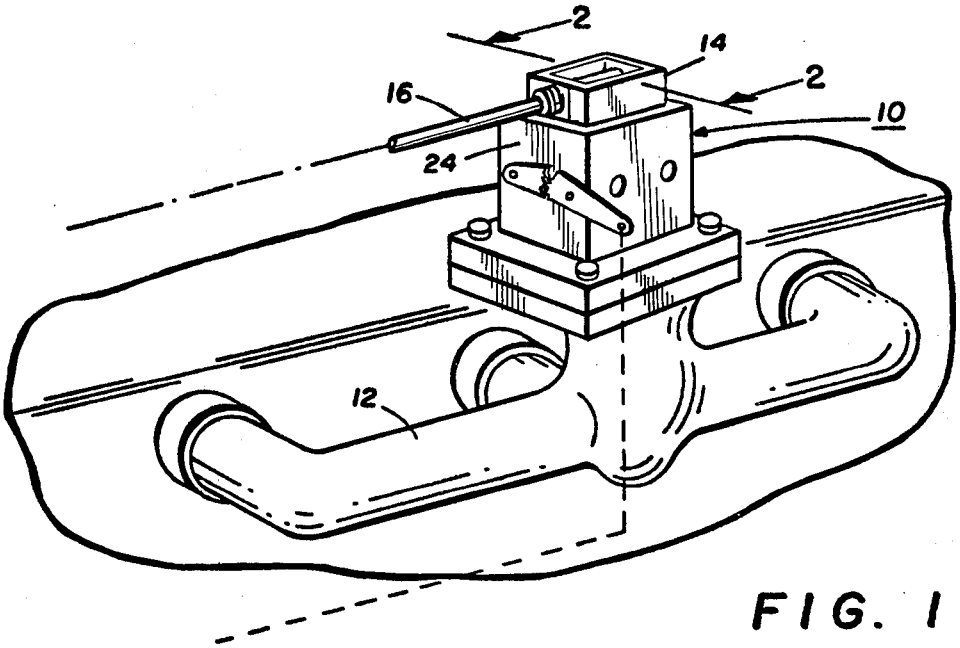
FIG. 1 is a partial respective view of the air-fuel mixing apparatus embodying the present invention and showing it as positioned on an internal combustion engine.

Turning now to the drawings, there is shown in FIG. 1 a mixing and modulating apparatus 10 embodying the present invention shown supported on an intake manifold 12 of an internal combustion engine. Apparatus 10 draws air through inlet duct 14 from the ambient environment while fuel is supplied thereto through fuel line 16. Fuel is supplied to fuel line 16 from an automobile fuel tank (not shown).

Mixing and modulating apparatus 10 will now be described with particular reference to FIG. 2. The apparatus comprises a housing designated 18 having an internally-central flow passage 20. The passage is adapted to communicate in a vertical direction with the intake manifold 12 through mounting in the form of a rectangular base 22. The duct 14 defines the air intake entrance to the passage.

Figure 2:
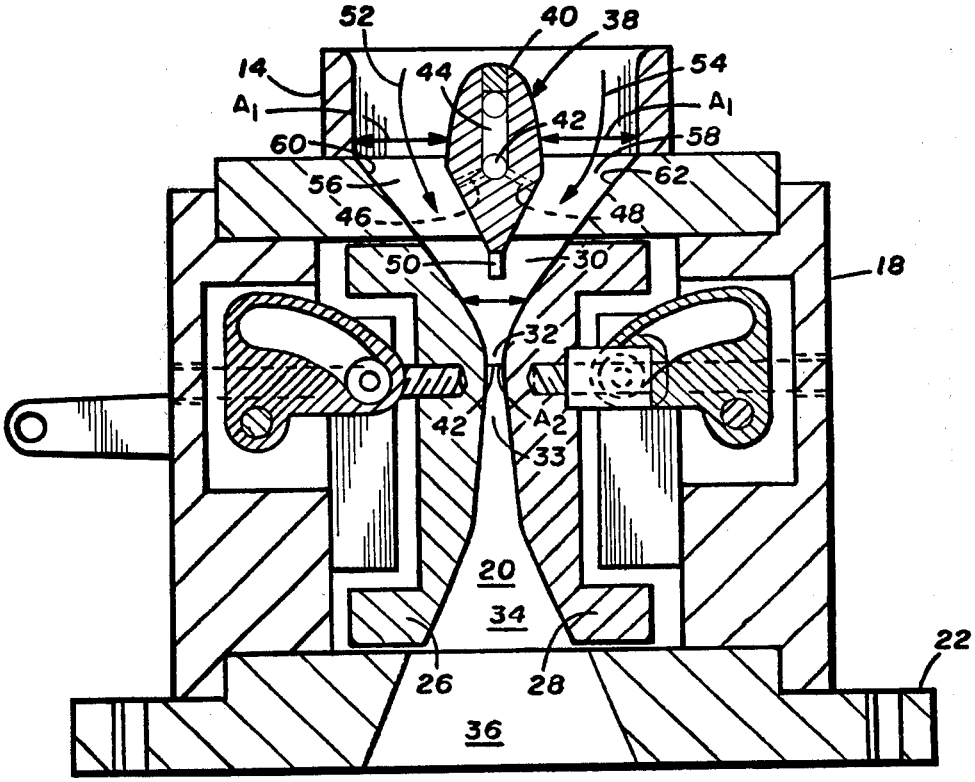
FIG. 2 is a view in section taken alone the lines 2—2 of FIG. 1.
Figure 3:
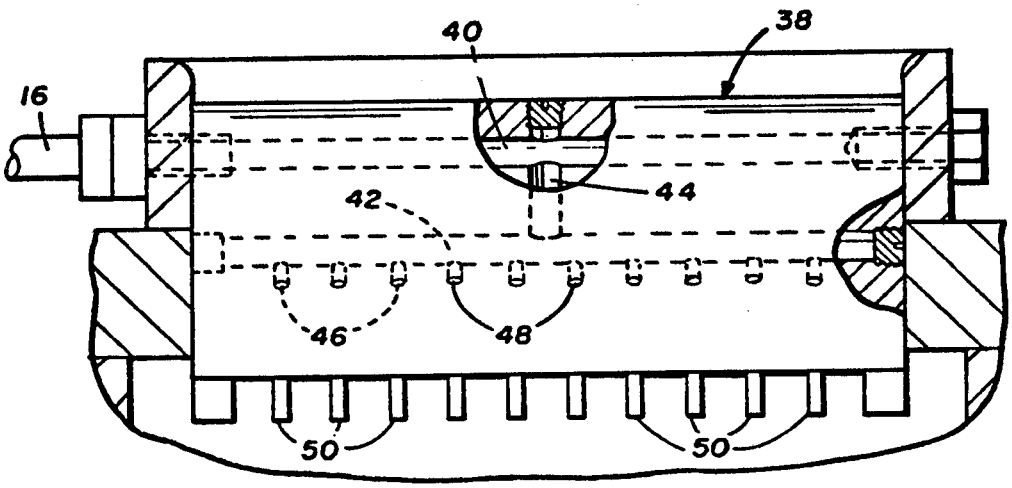
FIG. 3 is a view in side elevation of the fuel distributor or fuel bar shown in FIG. 2.

The geometric configuration of the flow passage 20 is defined on two sides by a pair of parallel slab-like stationary walls, the outside of one of which, 24, is shown in FIG. 1, together with a pair of opposite spaced-apart relatively movable jaw members 26 and 28 shown in FIG. 2. The latter jaw members are essentially symetrical in construction and are supported and moved relative to one another.

It will be seen that the central flow passage 20 includes a venturi 30 having a narrow throat section 32 constituting the point of maximum constriction of the passage, a primary diffuser section 33, formed beneath the throat section by the diverging portions of jaws 26 and 28 and, further downstream, a secondary diffuser section 34 formed by a more abrupt divergence of the lower portions of the jaws 26 and 28. In one embodiment of the device the secondary diffuser section is omitted and the primary diffuser 33 merges directly with the outlet aperture 36. Outlet aperture 36 leads into the intake manifold 12.

Figure 4:
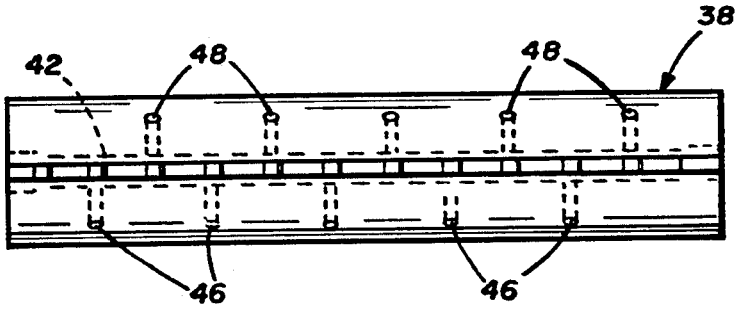
FIG. 4 is a bottom plan view of the distributor shown in FIG. 3.
Figure 5:
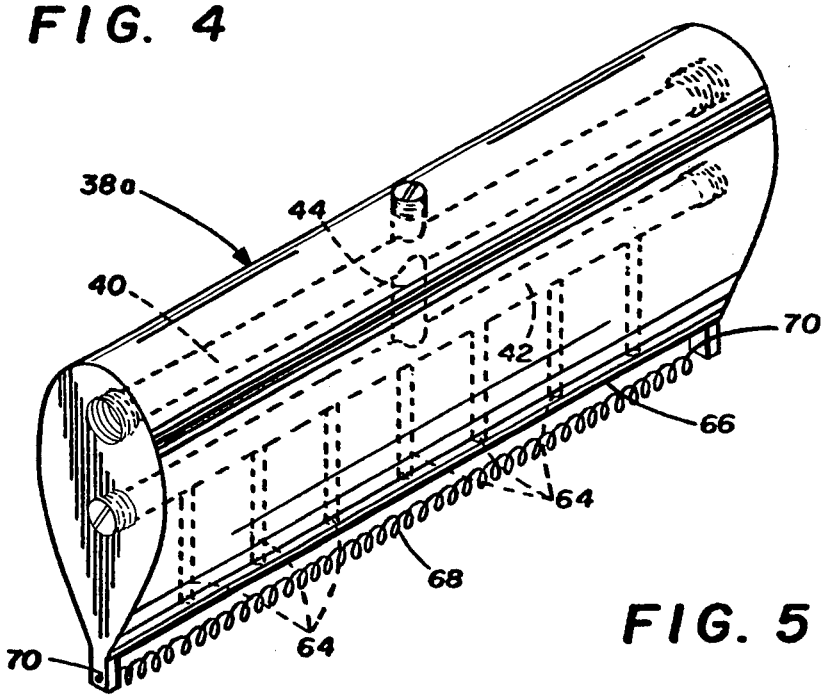

Positioned within the intake duct 14 and extending parallel to the jaws 26 and 28 is the fuel bar 38. The fuel bar is in the form of an elongated distributor and as shown in FIG. 2 is aerodynamically shaped with its cross-section forming an inverted tear-drop. As will be more fully explained later, this is to accomplish effective division and shaping of the inlet air stream. Fuel bar 38 is internally tapped to form an upper fuel inlet passage 40 and a lower inlet fuel passage 42 connected by intermediate passage 44. As particularly shown in FIG. 4, lower passage 42 communicates with the exterior of the fuel bar 38 through a series of spaced-apart openings 46 positioned along one side of the distributor and 48 positioned along the other side. As shown particularly in FIG. 4 openings 46 and 48 are spaced in alternating or staggered relationship intermediate one another.

Depending from the bottom, or downstream side of fuel bar 38, are a series of spaced-apart teeth 50 to minimize joinder of fuel streams from adjacent openings. Each tooth is aligned below a corresponding opening 46 or 48.

By virtue of the shaped cross-section of fuel bar 38, air drawn through the intake duct 14 is effectively divided into two shaped streams indicated in FIG. 2 as 52 and 54. These flow through air passages 56 and 58 defined by the outer surface of fuel bar 38 and inner surfaces 60 and 62 of the downstream portion of duct 14. Liquid fuel entering the interior of the bar through fuel passage 40 is conducted via intermediate passage 44 to a lower fuel inlet passage 42 and thence to the outer surface of fuel bar 38 via openings 46 and 48. The convergent intake air streams 52 and 54 are accelerated in passages 56 and 58 and so are at relatively high velocity when they strip the liquid fuel from the outer surface of the fuel bar adjacent the outlet ends of openings 46 and 48 and entrain them in the air stream. Just after entrainment, the direction of liquid and air flow are parallel. Thereafter, the entrained fuel is comminuted into finely divided droplets downstream.

Under most conditions of operation, the fuel will be entrained in streams 52 and 54 almost immediately upon emerging from openings 46 and 48. Under conditions of lower velocity air flow, however, such as will be encountered during the idling of the engine to which the mixing and modulating apparatus 10 is attached, fuel streams may tend to run down the exterior surface of fuel bar 38 toward its bottom or downstream sides. The purpose of the depending teeth 50 is to prevent such streams from bridging together at the downstream end of the fuel bar 38 where they might form large droplets incapable of being uniformly dispersed in the air stream that passes through central flow passage 20.

It should be appreciated that mixing and modulating apparatus 10 is intended to operate over extremely wide variations of both fuel and air flow rates. For example, for a 350 cu. in. displacement engine, the rate of fuel feed will be as low as about ½ gallon per hour when the engine is idling while it will be as much as 20 gallons per hour during maximum acceleration. Similarly the range of air flows for such an engine is extremely wide with rates of approximately 15 cu. ft. per minute at idle and 300–500 cu. ft. per minute during maximum acceleration. The apparatus of the present invention is well adapted for producing a uniformly dispersed mixture of fuel droplets in air for delivery to the central flow passage 20 over this very wide range of conditions. This is due at least in part to the effective division and shaping of the air into the two shaped convergent streams 52 and 54. It has been found that in order to accomplish this, the ratio of the total flow area in duct 14 surrounding the fuel bar (designated as A1 in FIG. 2) and the variable cross-sectional area of the throat 32 (hereinafter designated A2) preferably fall within a designated numerical range during substantially all of the operating range of the engine it feeds. Generally, the most desirable ratio of A1 to A2 is between about 4 and about 12.

It will be understood that many changes could be made in the above-described construction and apparently many widely different embodiments of this invention could be made without departing from the spirit thereof. It is, therefore, intended that all matter contained in the drawings and specification shall be interpreted as illustrative and not in a limiting sense.

The embodiments of the invention in which an exclusive property or privilege is claimed are defined as follows:

1. In combination with an air-liquid fuel induction device that includes an intake air duct having a converging portion, a variable area throat portion of rectangular cross-section through which a mixture of air and finely divided liquid fuel is passed at sonic velocity and a fuel supply, a fuel dispensing and air flow shaping device including in combination:

a. an elongated distributor body positioned upstream of the throat and extending within said air duct in a direction parallel to the longer axis of the rectangular throat, said distributor body being positioned at an intermediate location within said air duct to divide the flow of air into converging streams;

b. means forming a plurality of displaced fuel openings in said distributor body extending longitudinally therealong, said openings being located within the converging portion of the intake air duct and adapted to discharge fuel therefrom in a plurality of coherent liquid streams for atomization by the converging air streams;

c. means forming an internal passage within said distributor body and connected to said fuel supply communicating with the openings for the passage of liquid fuel;

d. fuel joinder prevention means attached to said distributor body positioned downstream of said openings and spaced therefrom, said fuel joinder prevention means being spaced along substantially the entire length of said body transversely of the direction of air flow and being effective to minimize joinder between streams of liquid fuel discharged from said openings, and e. the distributor body having an exterior surface position extending between the fuel openings and the joinder prevention means providing an uninterrupted surface over which fuel flows under conditions of relatively low air velocity moving past said openings.

2. Apparatus in accordance with claim 1 wherein the body of said distributor is aerodynamically shaped in cross-section, having the shape of a tear-drop with the smaller end thereof pointing in the direction of air flow.

3. Apparatus according to claim 1 wherein the ratio of the flow area defined by the air duct and the distributor to the area of the throat portion varies between about 4 and 12 over substantially the entire operating range of the engine fed by said device.

4. Apparatus according to claim 1 wherein the fuel joinder prevention means attached to the body of the distributor includes a plurality of spaced apart, depending teeth.

* * * * *

UNITED STATES PATENT AND TRADEMARK OFFICE

CERTIFICATE OF CORRECTION

PATENT NO. : 4,049,758

DATED : September 20, 1977

INVENTOR(S) : Robert Dixon Englert and Kenneth Ronald Armstrong

It is certified that error appears in the above-identified patent and that said Letters Patent are hereby corrected as shown below:

In the claims:

Claim 1, line 51, "position" should read "portion".

Claim 3, line 62, insert --about-- before "12".

Signed and Sealed this

*Twenty-seventh* Day of *December 1977*

[SEAL]

*Attest:*

RUTH C. MASON
*Attesting Officer*

LUTRELLE F. PARKER
*Acting Commissioner of Patents and Trademarks*